US007246544B1

(12) United States Patent
Lee

(10) Patent No.: US 7,246,544 B1
(45) Date of Patent: Jul. 24, 2007

(54) ROTARY WRENCH

(76) Inventor: Chang Chuan Lee, No. 429, Jhongjheng Rd., Caotun Township, Nantou County 542 (TW)

( * ) Notice: Subject to any disclaimer, the term of this patent is extended or adjusted under 35 U.S.C. 154(b) by 0 days.

(21) Appl. No.: 11/452,352

(22) Filed: Jun. 14, 2006

(51) Int. Cl.
*B25B 23/16* (2006.01)

(52) U.S. Cl. ..... 81/177.8; 81/60

(58) Field of Classification Search ..... 81/177.8, 81/177.7, 177.9; 403/119, 161
See application file for complete search history.

(56) References Cited

U.S. PATENT DOCUMENTS

| | | | | | |
|---|---|---|---|---|---|
| 103,656 | A * | 5/1870 | Redlinger | ..... | 81/57.5 |
| 648,572 | A * | 5/1900 | Patterson | ..... | 81/61 |
| 820,292 | A * | 5/1906 | Dunbar | ..... | 403/4 |
| 1,320,137 | A * | 10/1919 | Gunn | ..... | 81/62 |
| 1,331,956 | A * | 2/1920 | Cross | ..... | 81/60 |
| 2,504,796 | A * | 4/1950 | Daley | ..... | 403/93 |
| 2,608,894 | A * | 9/1952 | Miller, Jr. et al. | ..... | 81/177.9 |
| 2,977,824 | A * | 4/1961 | Otto | ..... | 81/177.8 |
| 4,274,309 | A * | 6/1981 | Lenker | ..... | 81/60 |
| 2006/0201288 | A1 * | 9/2006 | Chen | ..... | 81/177.8 |

* cited by examiner

*Primary Examiner*—D. S. Meislin

(57) ABSTRACT

A rotary wrench including a working head and a handle. The handle has two arms defining a holding space in which the working head is installed. The two arms are respectively formed with a first thread hole and a second thread hole with different spiral directions and opposite to each other. The working head has a first threaded end and a second threaded end opposite to each other respectively corresponding to the first and second thread holes of the handle. The first and second threaded ends have different spiral directions respectively corresponding to the spiral directions of the first and second thread holes of the handle. The first and second threaded ends of the working head are respectively screwed in the first and second thread holes of the handle. When the working head is screwed toward one side of the handle, the two arms are contracted to clamp the working head, while when the working head is screwed toward the other side of the handle, the two arms are stretched to loosen the working head and permit the working head to adjustably rotate relative to the handle into a predetermined angular position.

6 Claims, 7 Drawing Sheets

ROTARY WRENCH

BACKGROUND OF THE INVENTION

The present invention is related to a rotary wrench in which the working head can be conveniently tightened or loosened to adjust the angle of the working head for different operations.

FIG. 1 shows a conventional rotary wrench including a handle 10, a working head 14 and a locking member 16.

A front end of the handle 10 is formed with a holding space 11 defined between two arms. The arms are formed with opposite pivot holes 12. An elongated split 13 longitudinally extends from the bottom of the holding space 11 toward a rear end of the handle 10. In addition, the two arms are respectively formed with a through hole and a thread hole opposite to each other. Two pivot shafts 15 are disposed on two sides of the working head 14. The pivot shafts 15 are fitted in the pivot holes 12 of the arms to pivotally connect the working head 14 with the handle 10. In addition, the working head 14 has a coupling section 16 for coupling with a socket. The locking member 17 is passed through the through hole and screwed into the thread hole of the arms of the handle 10. When the working head 14 is rotated relative to the handle 10 to a desired angular position, the locking member 17 can be tightened to contract the two arms and narrow the holding space 11. At this time, the working head 14 is tightly clamped by the arms and fixed in the angular position. However, in actual operation, such conventional rotary wrench has some shortcomings as follows:

1. When the working head 14 is rotated relative to the handle 10, the coupling section 16 of the working head 14 will abut against the bottom wall of the holding space 11. Therefore, the rotational angle of the working head 14 is restricted within a certain range. This makes it inconvenient to operate the conventional rotary wrench.
2. The two arms of the handle 10 are respectively formed with the through hole and the thread hole opposite to the through hole. The locking member 17 is passed through the through hole and screwed into the thread hole of the arms to force the arms to tightly clamp the working head 14 and fix the working head 14 in a desired angular position. In manufacturing, it is necessary to drill holes on the arms and tap one of the holes for locking the locking member 17. This procedure leads to increment of the manufacturing cost.

SUMMARY OF THE INVENTION

It is therefore a primary object of the present invention to provide a rotary wrench in which the holding space has an elongated bottom portion permitting the coupling section of the working head to pass therethrough. Therefore, the working head can be rotated relative to the handle into any desired angular position for different operations. Accordingly, a user can conveniently operate the rotary wrench.

It is a further object of the present invention to provide the above rotary wrench in which the handle of the rotary wrench has two arms defining a holding space in which the working head is installed. The two arms are respectively formed with a first thread hole and a second thread hole with different spiral directions. The working head has a first threaded end and a second threaded end respectively corresponding to the first and second thread holes of the handle. The first and second threaded ends have different spiral directions respectively corresponding to the spiral directions of the first and second thread holes of the handle. The first and second threaded ends of the working head are respectively screwed in the first and second thread holes of the handle. When the working head is screwed toward one side of the handle, the working head is tightened, while when the working head is screwed toward the other side of the handle, the working head is loosened.

It is still a further object of the present invention to provide the above rotary wrench in which the handle can be directly drilled and tapped to form the opposite thread holes with different spiral directions. The working head can be directly pivotally mounted on the handle without using the locking member as in the conventional rotary wrench. This effectively lowers the manufacturing cost.

According to the above objects, the rotary wrench of the present invention includes a working head and a handle, wherein:

the handle has a first end for a user to grip and a second end, the second end of the handle including two stems and two arms obliquely extending from the two stems, the two arms defining a holding space and the two stems defining a split, the split longitudinally extending from a bottom of the holding space to the first end of the handle, the two arms being respectively formed with a first thread hole and a second thread hole with different spiral directions and opposite to each other; and the working head is disposed in the holding space and has a coupling section for coupling with a socket, the working head further having a first threaded end and a second threaded end arranged on a circumference of the working head opposite to each other respectively corresponding to the first and second thread holes of the two arms of the handle, the first and second threaded ends having different spiral directions respectively corresponding to the spiral directions of the first and second thread holes of the two arms of the handle, the first and second threaded ends of the working head being respectively screwed in the first and second thread holes of the two arms of the handle.

The present invention can be best understood through the following description and accompanying drawings wherein:

DETAILED DESCRIPTION OF THE PREFERRED EMBODIMENTS

Figure 1:
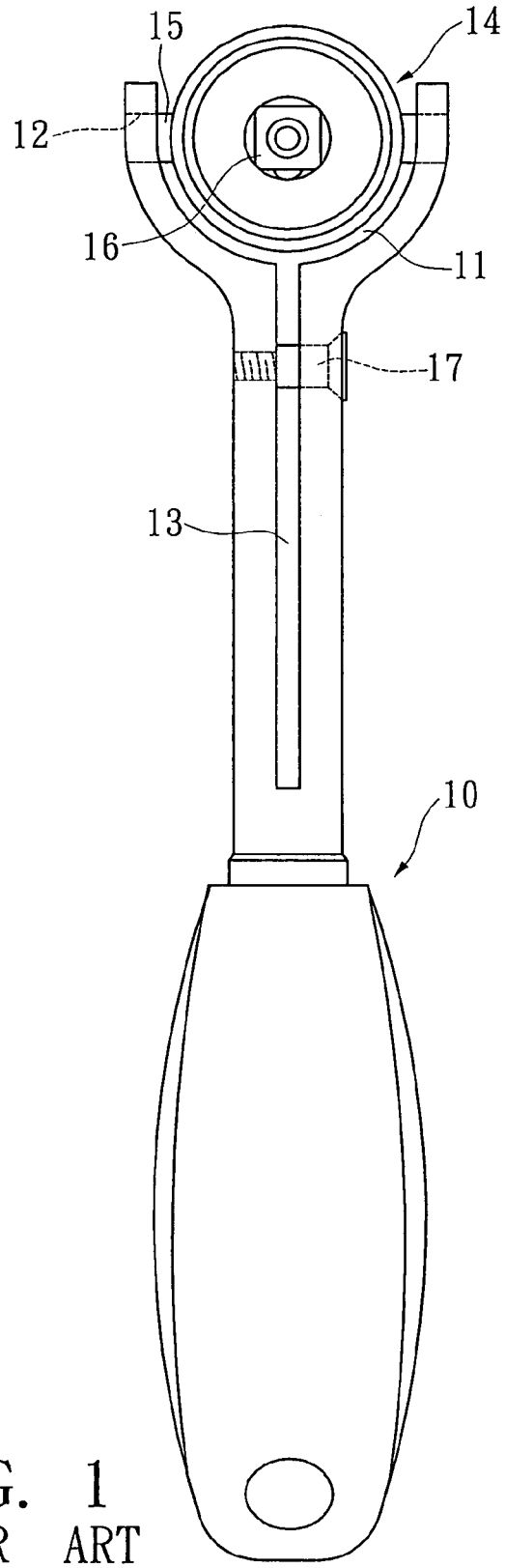
FIG. 1 PRIOR ART
FIG. 1 is a top view of a conventional rotary wrench.
Figure 2:
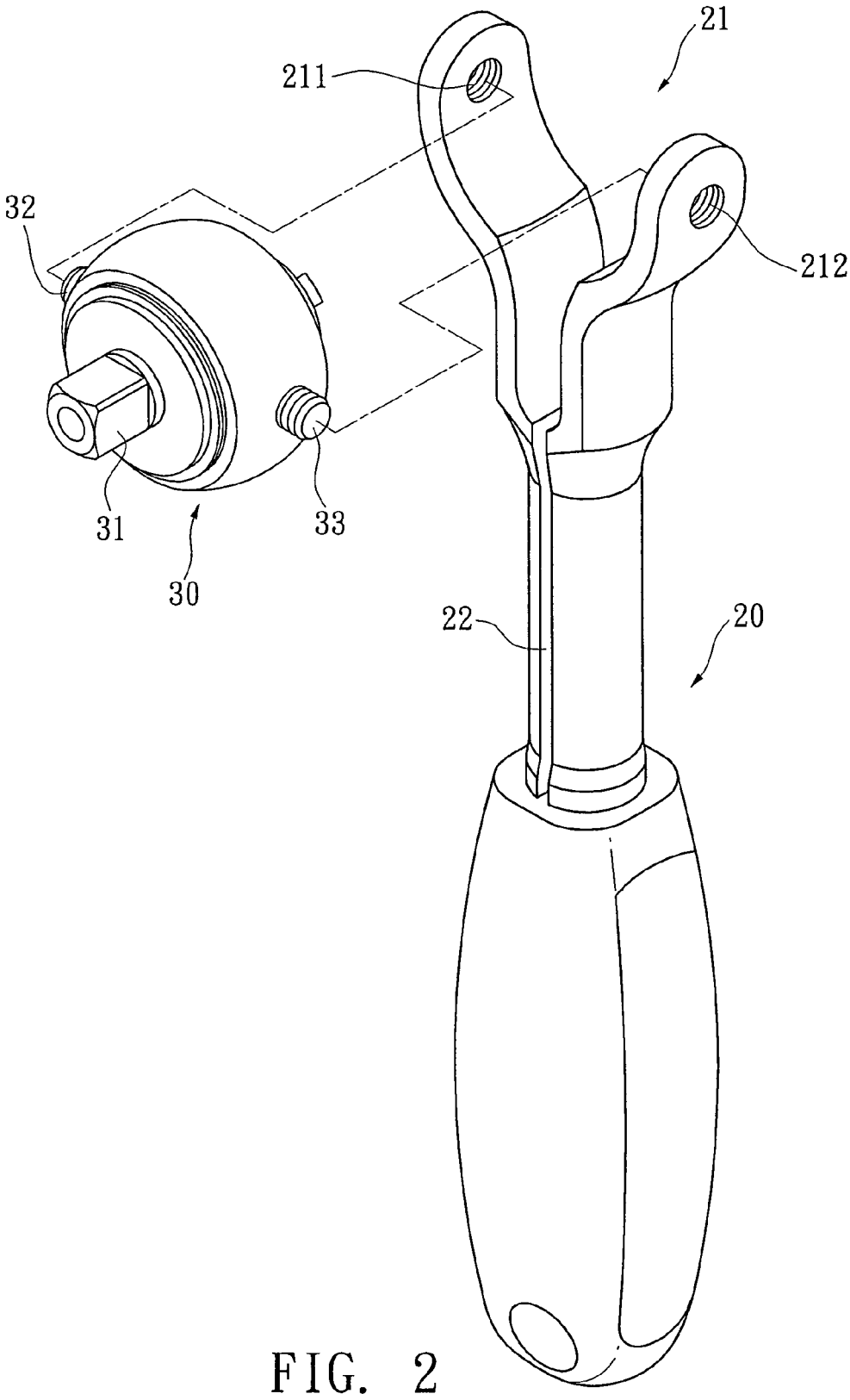
FIG. 2 is a perspective exploded view of a first embodiment of the rotary wrench of the present invention.
Figure 3:
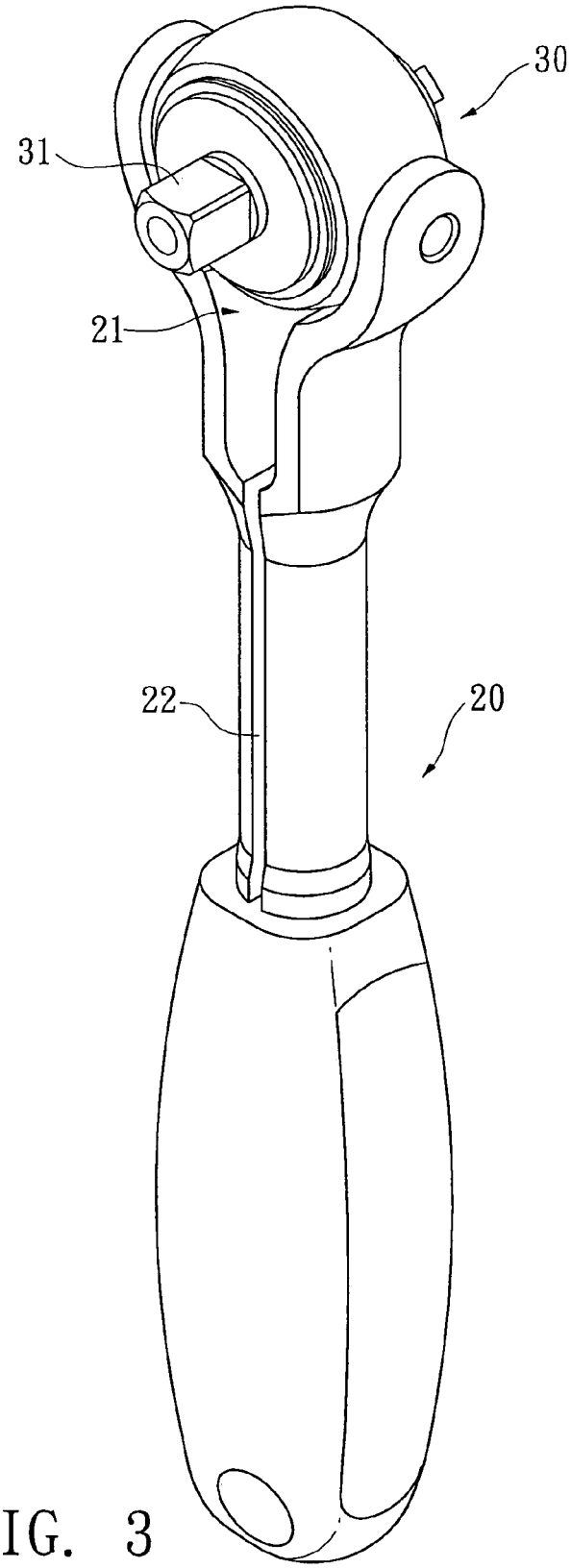
FIG. 3 is a perspective assembled view of the rotary wrench of the present invention.
Figure 4:
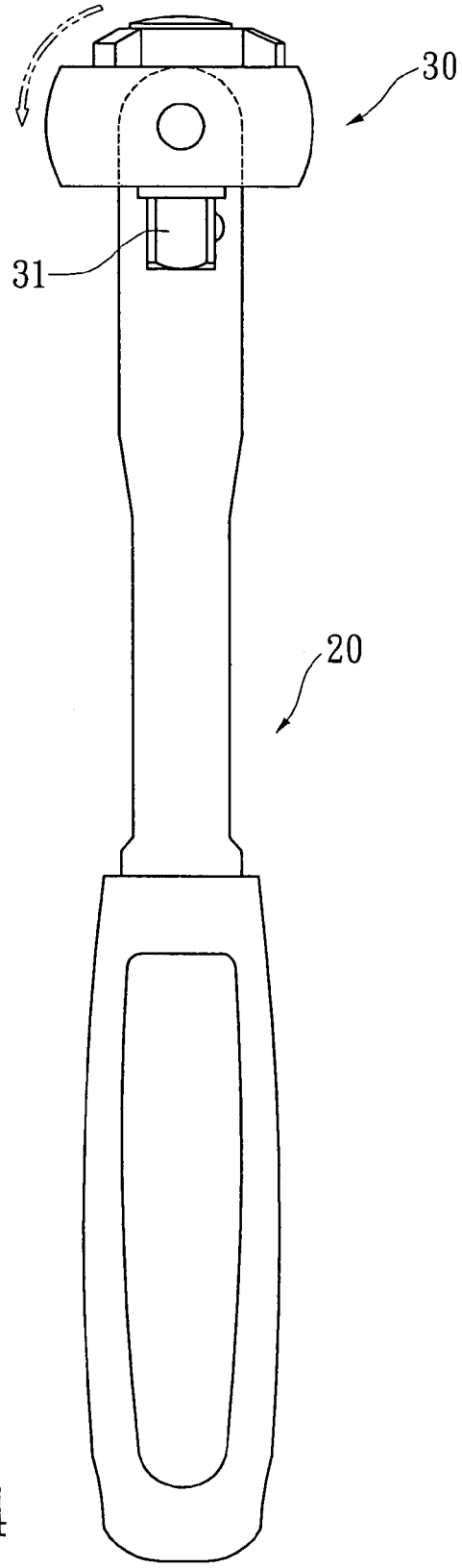
FIG. 4 is a top view of the rotary wrench of the present invention, showing that the working head is tightened.
Figure 5:
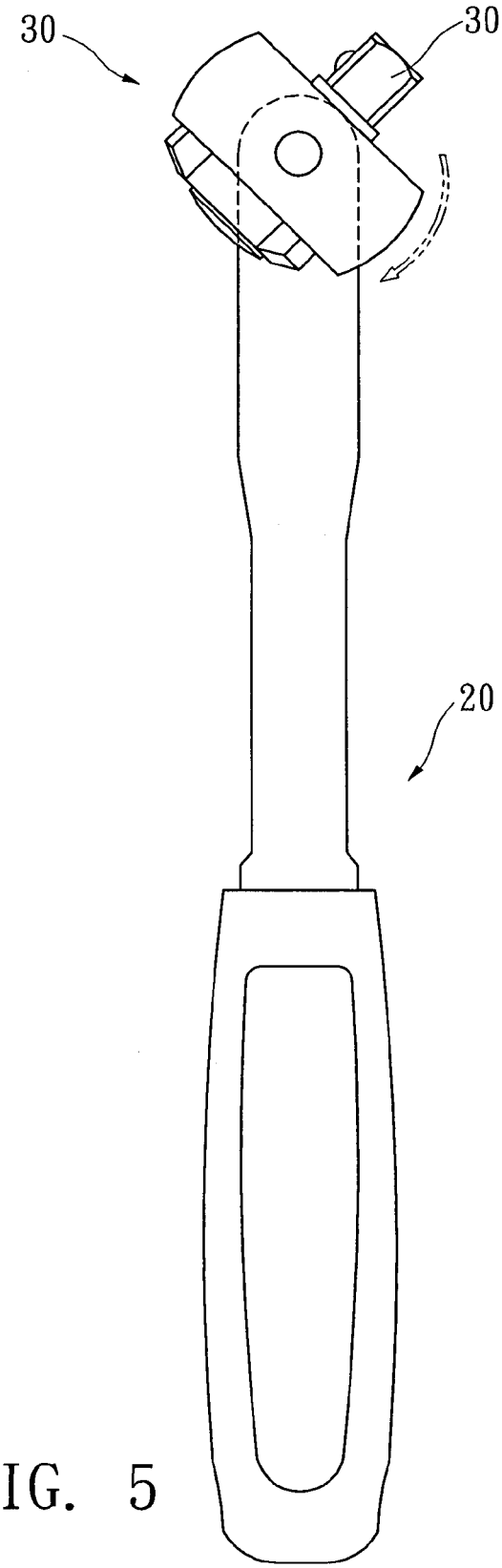
FIG. 5 is a top view of the rotary wrench of the present invention, showing that the working head is loosened.

Please refer to FIGS. 2 to 5. The rotary wrench of the present invention includes a handle 20 and a working head 30.

The handle 20 has a first end for a user to grip and a second end. The second end includes two stems and two arms obliquely extending from the two stems. The two arms define a holding space 21 and the two stems define a split 22. The arms are respectively formed with a first thread hole 211 and a second thread hole 212 with different directions of spiral and opposite to each other. The split 22 longitudinally extends from a bottom of the holding space 21 to the first end of the handle 20. In this embodiment, the split 22 is tapered. Alternatively, the split 22 can be a rectangular split. The working head 30 has a first threaded end 32 and a second threaded end 33 arranged on a circumference of the working head opposite to each other. The first and second threaded ends 32, 33 are respectively screwed in the first thread hole 211 and the second thread hole 212 of the arms. The spiral directions of the first and second threaded ends 32, 33 respectively correspond to the spiral directions of the first and second thread holes 211, 212 of the two arms of the handle 20. In this embodiment, the first threaded end 32 and the first thread hole 211 have left-handed threads, while the second threaded end 33 and the second thread hole 212 have right-handed threads. When the working head 30 is screwed toward one side of the handle 20, the two arms are contracted to tightly clamp the working head 30, while when the working head 30 is screwed toward the other side of the handle 20, the two arms are stretched to loosen the working head 30. By means of the split 22 of the handle 20, the two arms can be forced to get closer to each other or displace away from each other.

It should be noted that the threaded ends 32, 33 of the working head 30 are perpendicularly pivotally connected with the two arms of the handle 20. The holding space 21 has an elongated bottom portion permitting the coupling section 31 of the working head 30 to pass therethrough. Therefore, the working head 30 can be rotated relative to the handle 20 into any desired angular position for different operations. Accordingly, a user can conveniently operate the rotary wrench.

In manufacturing procedure, the two arms of the handle 20 can be directly drilled and tapped to form the opposite thread holes 211, 212 with different spiral directions. The working head 30 can be directly pivotally mounted on the handle 20 without using the locking member as in the conventional rotary wrench. This effectively lowers the manufacturing cost.

Figure 6:
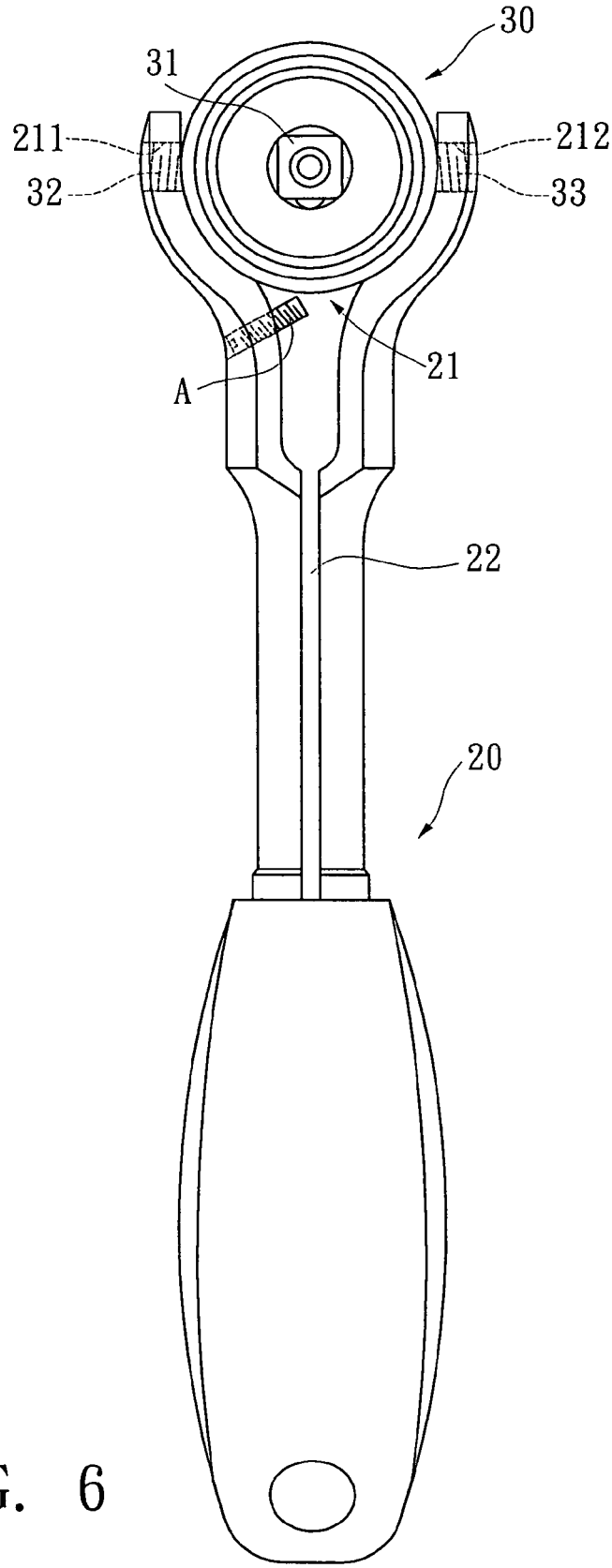
FIG. 6 is a top view of a second embodiment of the rotary wrench of the present invention, showing that a stopper member is disposed on the handle.

FIG. 6 shows a second embodiment of the present invention, which is different from the first embodiment in that a stopper member A is additionally disposed on the handle 20 in a position where the stopper member A can abut against the coupling section 31 of the working head 30. Therefore, the working head 30 can be only rotated within a certain range. This is for avoiding over-tightening and clog of the working head 30 or over-loosening and dropping of the working head 30.

Figure 7:
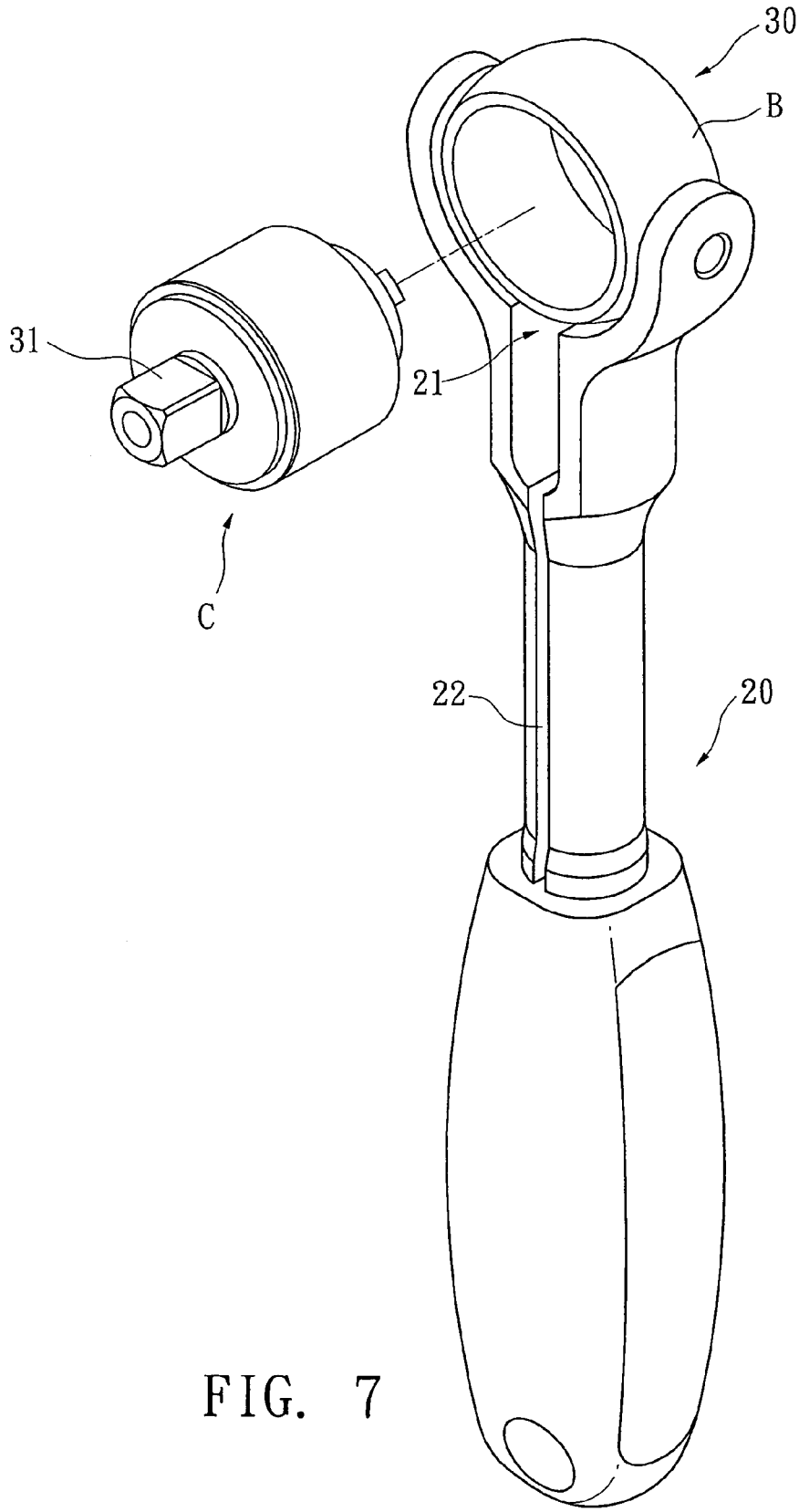
FIG. 7 is a perspective exploded view of a third embodiment of the rotary wrench of the present invention.

FIG. 7 shows a third embodiment of the present invention, which is different from the first embodiment in that the working head 30 is composed of a working head main body B and a socket-coupling member C. The socket-coupling member C can be fast extracted out of the main body B and replaced with another. The main body B can be rotated relative to the handle 20 to a predetermined angular position. Then the socket-coupling member C is detachably installed into the main body B.

The above embodiments are only used to illustrate the present invention, not intended to limit the scope thereof. Many modifications of the above embodiments can be made without departing from the spirit of the present invention.

What is claimed is:

1. A rotary wrench comprising a working head and a handle, wherein:

the handle has a first end for a user to grip and a second end, the second end of the handle including two stems and two arms obliquely extending from the two stems, the two arms defining a holding space and the two stems defining a split, the split longitudinally extending from a bottom of the holding space to the first end of the handle, the two arms being respectively formed with a first thread hole and a second thread hole with different spiral directions and opposite to each other; and the working head is disposed in the holding space and has a coupling section for coupling with a socket, the working head further having a first threaded end and a second threaded end arranged on a circumference of the working head opposite to each other respectively corresponding to the first and second thread holes of the two arms of the handle, the first and second threaded ends having different spiral directions respectively corresponding to the spiral directions of the first and second thread holes of the two arms of the handle, the first and second threaded ends of the working head being respectively screwed in the first and second thread holes of the two arms of the handle, whereby when the working head is screwed toward one side of the handle, the two arms are contracted to tightly clamp the working head, while when the working head is screwed toward the other side of the handle, the two arms are stretched to loosen the working head and permit the working head to adjustably rotate relative to the handle into a predetermined angular position.

2. The rotary wrench as claimed in claim 1, wherein a stopper member is disposed on the handle in a position where the stopper member can abut against the coupling section of the working head, whereby the working head can be only rotated within a certain range.

3. The rotary wrench as claimed in claim 1, wherein the first threaded end and the first thread hole have left-handed threads, while the second threaded end and the second thread hole have right-handed threads or the first threaded end and the first thread hole 1 have right-handed threads, while the second threaded end and the second thread hole have left-handed threads.

4. The rotary wrench as claimed in claim 1 or 3, wherein the first and second threaded ends of the working head are perpendicularly pivotally connected with the two arms of the handle.

5. The rotary wrench as claimed in claim 1, wherein the split is tapered.

6. The rotary wrench as claimed in claim 1, wherein the split is a rectangular split.

* * * * *